US006367909B1

(12) United States Patent
Lean

(10) Patent No.: US 6,367,909 B1
(45) Date of Patent: Apr. 9, 2002

(54) METHOD AND APPARATUS FOR REDUCING DROP PLACEMENT ERROR IN PRINTERS

(75) Inventor: Meng H. Lean, Briarcliff Manor, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/447,610

(22) Filed: Nov. 23, 1999

(51) Int. Cl.[7] ..... B41J 23/00; B41J 2/15

(52) U.S. Cl. ..... 347/37; 347/40

(58) Field of Search ..... 347/20, 37, 44, 347/46, 55, 74, 76, 78, 79, 12, 40

(56) References Cited

U.S. PATENT DOCUMENTS

| | | | | |
|---|---|---|---|---|
| 4,308,547 A | | 12/1981 | Lovelady et al. | 347/46 |
| 4,379,301 A | | 4/1983 | Fischbeck | 347/39 |
| 4,386,358 A | | 5/1983 | Fischbeck | 347/55 |
| 4,479,135 A | * | 10/1984 | Kohashi | 347/55 |
| 4,551,731 A | * | 11/1985 | Lewis et al. | 347/78 |
| 4,697,195 A | | 9/1987 | Quate et al. | 347/46 |
| 5,028,937 A | | 7/1991 | Khuri-Yakub et al. | 347/46 |
| 5,087,931 A | | 2/1992 | Rawson | 347/46 |
| 5,619,313 A | | 4/1997 | Domoto et al. | 399/233 |
| 5,697,609 A | | 12/1997 | Williams et al. | 271/228 |
| 5,715,514 A | | 2/1998 | Williams et al. | 399/395 |
| 5,808,636 A | | 9/1998 | Stearns | 347/46 |
| 5,864,127 A | | 1/1999 | Jackson et al. | 235/454 |
| 5,975,683 A | | 11/1999 | Smith et al. | 347/55 |
| 6,185,399 B1 | | 2/2001 | Zhao et al. | 399/223 |

FOREIGN PATENT DOCUMENTS

| | | |
|---|---|---|
| EP | 0 832 742 | 4/1998 |
| EP | 0 887 196 | 12/1998 |
| EP | 0 965 450 | 12/1999 |

* cited by examiner

*Primary Examiner*—Hai Pham
(74) *Attorney, Agent, or Firm*—Fay, Sharpe, Fagan, Minnich & McKee, LLP

(57) ABSTRACT

This invention relates to a method and apparatus for reducing drop placement error of ink drops emitted by printheads, e.g. acoustic ink printing (AIP) printheads, in printers. Ink types include aqueous and phase change (hot melt), with finite electrical conductivity to allow inductive charging at drop ejection. More particularly, two schemes are contemplated to facilitate reduction of drop placement error, preferably to zero, for printing on planar or non-planar medium. In both schemes, segmented counter electrodes are biased at iteratively predetermined voltages and located across a print gap from drop ejectors integrated in the printheads. For printing on stationary medium such as paper on a belt or platen, absolute drop placement error for each ejector row is maintained to be zero to obtain the required bias electrode voltages. For printing on moving medium such as paper on a drum, the same time of flight for all ejector rows referenced to the 1$^{st}$ row is maintained, thus resulting in the relative drop placement error being zero and the absolute error being negligibly small.

20 Claims, 13 Drawing Sheets

LEGEND:

$w$ - DISTANCE FROM NOZZLE TO THE PLANE OF SYMMETRY $r_{drum}$ - DRUM RADIUS $\alpha,\beta,\gamma$ - ARC ANGLES FOR DROP IMPACT ON DRUM

METHOD AND APPARATUS FOR REDUCING DROP PLACEMENT ERROR IN PRINTERS

BACKGROUND OF THE INVENTION

This invention relates to a method and apparatus for reducing drop placement error of ink drops emitted by printheads, e.g. acoustic ink printing (AIP) printheads, in printers. Ink types include aqueous and phase change (hot melt), with finite electrical conductivity to allow inductive charging at drop emission. More particularly, two schemes are contemplated to facilitate reduction of drop placement error, preferably to zero, for printing on print medium. In both schemes, segmented counter electrodes are biased at iteratively predetermined voltages and located across a print gap from drop ejectors integrated in the printheads. For printing on stationary medium such as paper on a belt or platen, absolute drop placement error for each ejector row is maintained to be zero to obtain the required bias electrode voltages. For printing on moving medium such as paper on a drum, the same time of flight for all ejector rows referenced to the $1^{st}$ row is maintained, thus resulting in the relative drop placement error being zero and the absolute error being negligibly small.

While the invention is particularly directed to the art of drop placement in the context of acoustic ink printing where the print medium is or is disposed on a curved surface, and will be thus described with specific reference thereto, it will be appreciated that the invention may have usefulness in other fields and applications. For example, the invention may be used to print on planar surfaces as well as in a variety of ink jet printing applications.

By way of background and generally, in many printing applications, drops of ink are ejected or emitted on demand and deposited onto a medium to form the printed image. For high resolution print images, a combination of small drop size and precise drop placement are necessary to ensure good image quality. The requirement for accurate drop placement is especially critical for color printing on moving non-planar print media such as drums or belts.

More specifically, acoustic ink printing involves the emission of a droplet of ink from a pool of ink toward a print medium. Acoustic waves are generated and focussed toward the surface of the ink pool to emit the droplet therefrom. While acoustic ink printing elements may take various forms, such elements typically include a piezoelectric transducer to generate the acoustic waves, a lens to focus the waves at the surface of the ink pool, a cover plate with apertures formed therein to allow emission of the ink, and corresponding wiring. It is to be appreciated that approximately one thousand (1,000) or more of these elements may be disposed on a single printhead in a variety of configurations. Typically, however, the printing elements are formed in eight rows along the length of the printhead. Acoustic ink printing systems are disclosed, for example, in U.S. Pat. Nos. 4,308,547; 4,697,195; 5,028,937; and 5,087,931, all of which are incorporated herein by reference.

The advantages of electrostatic field acceleration in reducing drop placement errors for both aqueous and phase change AIP efforts are known. Errors in drop placement due to transverse disturbances, such as airflow and skewed drop ejection, are reduced by providing a Coulomb force component normal to the printing surface to attract the drops. This force also acts to overcome drag, thus providing an impetus for the drop to move across the print gap. Otherwise, the drop may decelerate and fall back onto the print head leading to contamination problems that adversely affect print head reliability and lifetime. Another important advantage is the reduction in mechanical energy for drop ejection by supplying just sufficient energy for drop formation; and then using the electrostatic field to accelerate the drop. This measure results in significant reduction of power.

U.S. Pat. Nos. 4,386,358 and 4,379,301 to Fischbeck, which are commonly assigned and incorporated herein by reference, disclose a method for electrostatically deflecting electrically charged ink drops emitted from an ink jet printhead. Charges placed on electrodes on the printhead disclosed by Fischbeck are controlled to steer the charged ink drops in desired directions to compensate for known printhead movement. By electrostatically steering the charged ink drops, the method disclosed in Fischbeck compensates for ink drop misdirection caused by the known printhead movement when the ink drop is emitted.

However, the electrostatic deflection method disclosed by Fischbeck does not compensate for unpredictable environmental factors that can affect ink drop trajectories. Such environmental factors include air currents and temperature gradients between the printhead and the print substrate. In acoustic ink jet printheads, unpredictable variations in the dynamics of ink drop creation also detrimentally affect ink drop trajectories. Some of the variations in ink drop creation are caused by aberrations in the lithography of Fresnel lens which are in some embodiments used to focus the acoustic wave used to create the ink drops.

U.S. Pat. No. 5,975,683 entitled Electric-Field Manipulation of Emitted Ink Drops in Printing, which is commonly assigned, and is hereby incorporated by reference, discloses the use of an electric field to reduce droplet misdirectionality, by inducing a charge on a drop as it breaks off from the bulk of the fluid. The charged drop is then accelerated into the paper, by holding the paper at a relatively large potential (this same potential may be used to induce the charge on the drop). The application teaches selectively deflecting the ink drops slightly to enhance the resolution of the image produced by a given printhead configuration. The ink jet actuators form and impart an initial velocity on the ink drops. The charged ink drops are then steered by electrodes such that the drops alternately impact upon the print medium at positions slightly offset from positions directly opposite the apertures of the printhead.

This approach, though useful, has drawbacks. It requires large voltages, of the order of 1 to 2 kV. Also, it will suffer from many of the same imaging artifacts as occur in ionographic printing, where because charge is deposited onto the printing substrate, there is print-dependent interaction of the accelerating field with the charged drop. That is, as drops are accumulated on the paper, so is their charge. If this charge is not removed quickly enough, it will produce a print-dependent potential at the paper surface, which will interfere with the acceleration of subsequent drops. Finally, the acceleration expected for drops under typical print conditions is only large enough to reduce the misplacement of drops by some 50% at the paper surface, so that the correction of the misdirection, while significant, is not complete.

U.S. patent application Ser. No. 08/721,290 (filed Sep. 26, 1996) entitled Method and Apparatus for Moving Ink Drops Using an Electric Field, which is commonly assigned, and is hereby incorporated by reference, discloses using an electric field to charge and impart a force onto ink drops to control for motion of the ink drops, including biasing the print support medium with a voltage source.

U.S. patent application Ser. No. 09/098,763 (filed Jun. 17, 1998) entitled "Reduction of Spot Misplacement Through Electrostatic Focusing of Uncharged Drops", which is commonly assigned and hereby incorporated herein by reference, is directed to lateral focus of aqueous ink drops onto a substrate through implementation of electric fields for use in acoustic ink printing.

Known techniques do not take into account, however, that the print medium may be non-planar, e.g. comprised of a curved surface. These techniques only effectively contemplate the placement of drops on a planar medium. This is significant because the geometry of the print medium presents an additional complicating source for drop placement error. Addressing the problems associated with printing on a curved surface is particularly important in high volume printing systems where drums are used in the system to increase productivity.

The present invention contemplates a new and improved apparatus and method useful for realizing reduced, e.g. zero, drop placement error in printing applications, e.g. acoustic ink printing applications, that resolve the above-referenced difficulties and others.

SUMMARY OF THE INVENTION

A method and apparatus for reducing drop placement error in printing systems are provided. The printing systems have a printhead positioned to emit drops of ink toward target positions on a print medium positioned on a curved surface. The printhead has rows of emitters and the curved surface has embedded therein segmented electrodes. The electrodes are respectively aligned with the rows.

In one aspect of the invention, the method comprises steps of iteratively determining voltages to apply to the electrodes, biasing the electrodes based on the determined voltages, and, selectively emitting the drops of ink from emitters such that the drops follow respective paths from the emitters to the target positions on the print medium based on the biasing and position of the electrodes relative to the print medium.

In another aspect of the invention, the determining of the voltages is based on whether the print medium is in motion during the emitting.

In another aspect of the invention, if the print medium is in motion during the emitting, the voltages are determined based on maintaining a substantially identical time of flight for the emitted drops.

In another aspect of the invention, if the print medium is stationary during the emitting, the voltages are determined to achieve substantially zero absolute error for drop placement.

In another aspect of the invention, the apparatus comprises a head having rows of fluid emitters disposed thereon—the emitters including apertures formed in a cover plate of the printhead and the cover plate being connected to ground, a controller operative to control emission of drops of fluid from the emitters, a curved surface having embedded therein electrodes aligned with the rows of emitters—the curved surface being positioned across a gap from the head, and a processor operative to iteratively determine respective voltages to bias the electrodes—wherein the drops of fluid are selectively emitted from the emitters of the printhead based on signals from the controller and emitted such that the drops follow respective paths from the grounded cover plate of the emitters to the target positions on the print medium based on the biasing and position of the electrodes relative to the print medium.

In another aspect of the invention, the head is stationary.

In another aspect of the invention, the apparatus further comprises means for moving the head relative to the print medium during printing.

In another aspect of the invention, the curved surface is disposed on a drum.

In another aspect of the invention, the curved surface is disposed on a shoe.

In another aspect of the invention, the apparatus further comprises means for moving the print medium relative to the head.

In another aspect of the invention, the processor includes means for determining the voltages based on whether the print medium is in motion during the printing.

In another aspect of the invention, if the print medium is in motion during the emitting, the determining means determines the voltages based on criteria to maintain a substantially identical time of flight for the emitted drops.

In another aspect of the invention, if the print medium is stationary during the emitting, the determining means determines the voltages to achieve substantially zero absolute error for drop placement.

In another aspect of the invention, the apparatus comprises means for emitting drops of ink toward target positions on a print medium—the emitting means having rows of emitters, means for supporting the print medium—the supporting means having embedded therein segmented electrodes and the electrodes being respectively aligned with the rows, means for iteratively determining voltages to apply to the electrodes, means for biasing the electrodes based on the determined voltages, and means for selectively emitting the drops of ink from the emitting means such that the drops follow respective paths to the target positions on the print medium based on the biasing and position of the electrodes relative to the print medium.

In another aspect of the invention, the means for determining the voltages bases the determination on whether the print medium is in motion during the emitting.

In another aspect of the invention, if the print medium is in motion during the emitting, the voltages are determined based on maintaining a substantially identical time of flight for the emitted drops.

In another aspect of the invention, if the print medium is stationary during the emitting, the voltages are determined to achieve substantially zero absolute error for drop placement.

Further scope of the applicability of the present invention will become apparent from the detailed description provided below. It should be understood, however, that the detailed description and specific examples, while indicating preferred embodiments of the invention, are given by way of illustration only, since various changes and modifications within the spirit and scope of the invention will become apparent to those skilled in the art.

DESCRIPTION OF THE DRAWINGS

The present invention exists in the construction, arrangement, and combination of the various parts of the device, and steps of the method, whereby the objects contemplated are attained as hereinafter more fully set forth, specifically pointed out in the claims, and illustrated in the accompanying drawings in which:

DETAILED DESCRIPTION OF THE PREFERRED EMBODIMENTS

Figure 1:
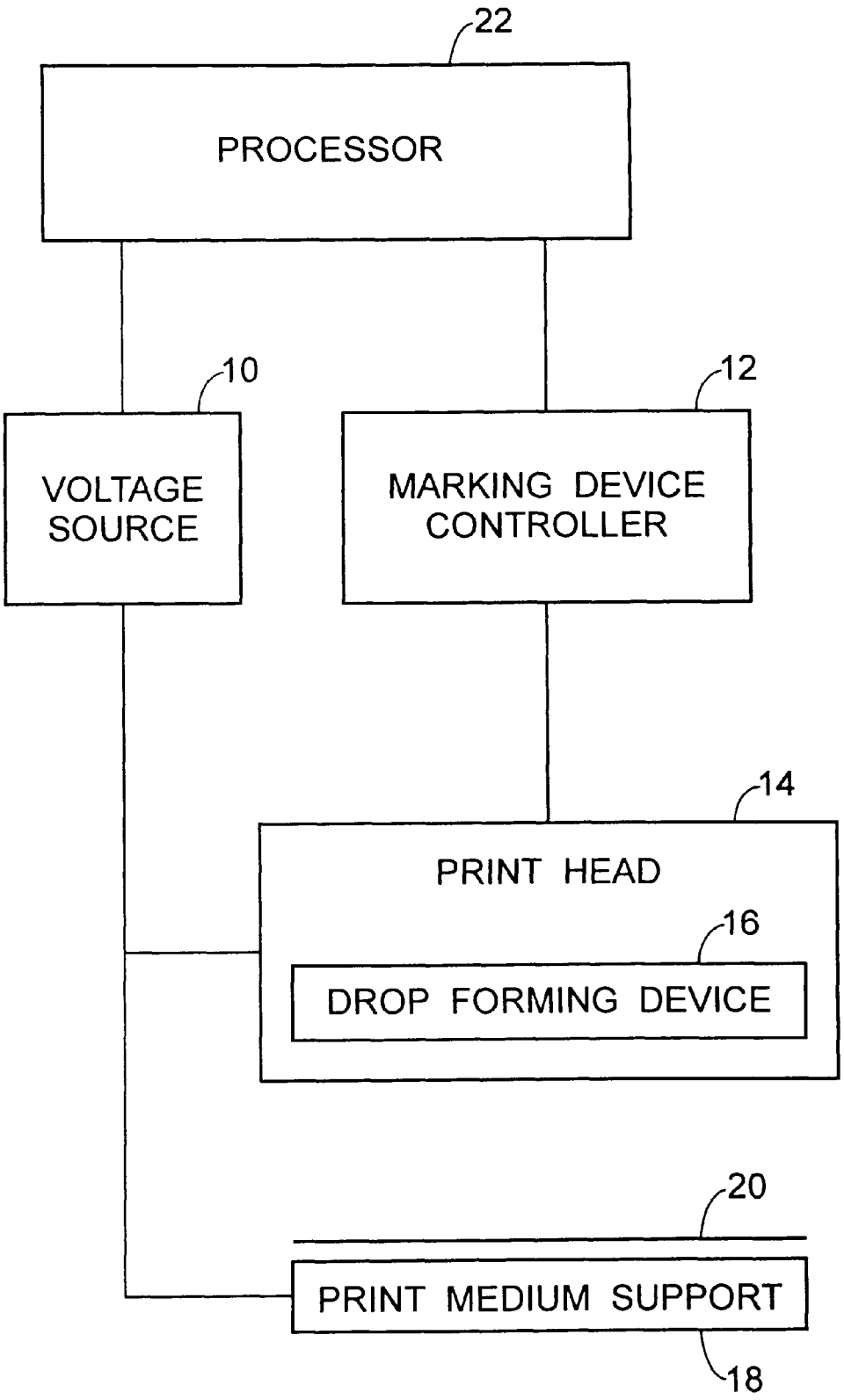
FIG. 1 is a schematic illustration of an overall system according to the present invention.

Referring now to the drawings wherein the showings are for purposes of illustrating the preferred embodiments of the invention only and not for purposes of limiting same, FIG. 1 provides a view of an overall preferred system according to the present invention. This system, it is to be recognized, is preferably included in a printer; however, the embodiments disclosed herein could be suitably adapted and included in a variety of other imaging devices such as copiers, scanners, etc.

In FIG. 1, a voltage source 10 is shown coupled to a print head 14 (which includes rows of emitters) and to a print medium support 18, which preferably takes the form of a curved surface as shown hereafter. A marking device controller 12 directly communicates with and is coupled to the print head 14. The marking device controller 12 controls a print medium movement mechanism (not specifically shown but may include the support 18 or the medium 20) that moves a print medium 20 relative to the print head 14. The controller 12 also controls the emission of drops from the printhead by sending signals to the printhead that specify the emitters to activate for the emission. The print medium 20 is preferably a sheet or roll of paper, but can also be transparencies, a transport belt, an intermediate transfer substrate or other materials.

In one embodiment, the print head 14 is a page-width print head and the print medium 20 is moved relative to the print head 14. Alternatively, the print head 14 can be configured as a scanning print head to move relative to either a stationary or a movable print medium.

The print head 14 includes a drop forming device 16, e.g. rows of emitters. In one embodiment, the drop forming device 16 is an acoustic ink drop actuator or emitter, although other types of ink drop actuators, including thermal and piezoelectric transducer-type actuators, may be used. Also shown is a processor 22 that performs/controls the methods and processing techniques according to the present invention in manners that will be apparent to those skilled in the art upon a reading of the present disclosure.

Figure 2:
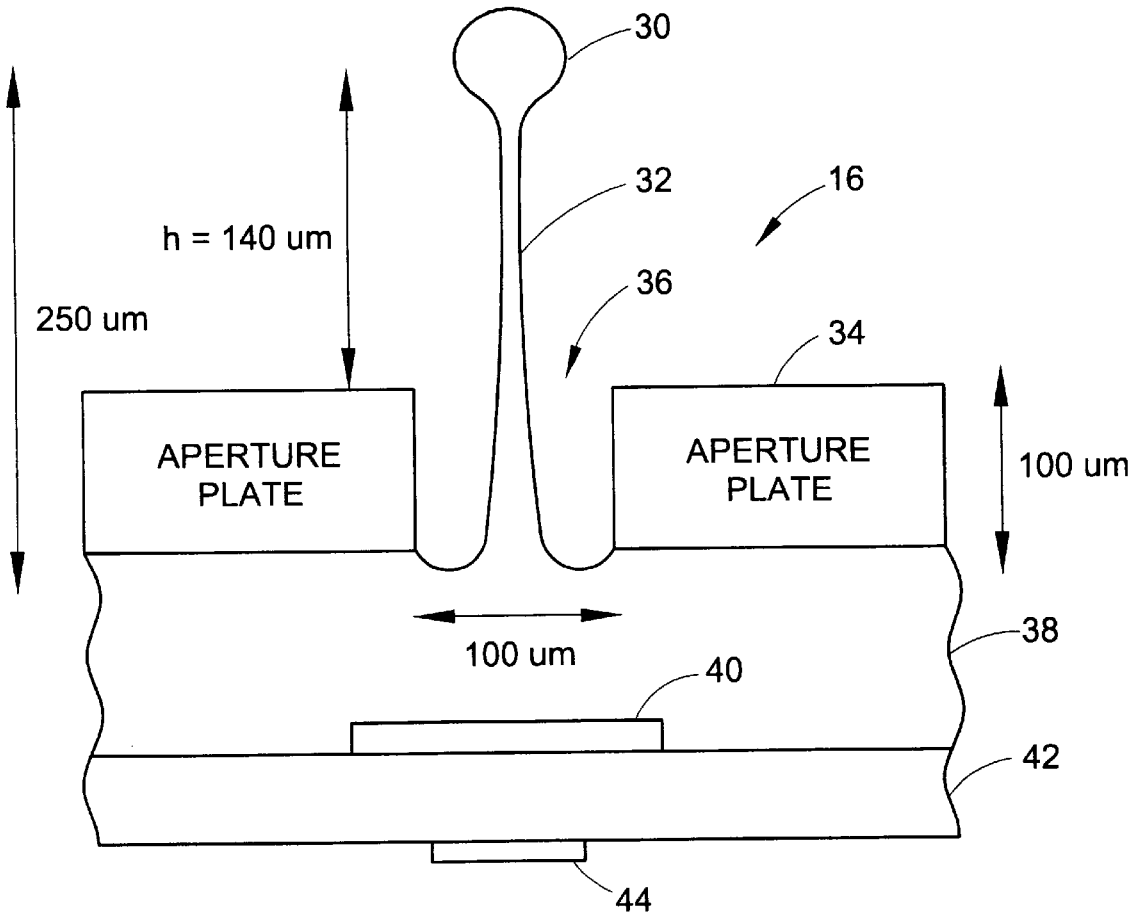
FIG. 2 is an illustration showing drop emission geometry.

Referring now to FIG. 2, implementation of an electrostatic field assist requires that the ink be sufficiently conductive so that the induced charge is distributed primarily on the surface of a drop 30 prior to separation from a plume 32. FIG. 2 shows the drop ejection geometry prior to separation of the drop 30 from the plume 32. The charge on the drop can be quantified:

$$Q_{drop}=4\pi\epsilon_o r_{drop} h\ E$$

where $Q_{drop}$, $r_{drop}$, h, and E are drop charge, drop radius, plume height, and gap E field.

As shown, in an emitter, the drop 30 is emitted from a pool 38 of fluid, preferably ink, through aperture 36 defined in aperture or cover plate 34. The emission occurs as a result of a focussing of acoustic energy, e.g. acoustic waves, at the surface of the pool 38 by a lens structure representatively shown at 40. The waves are propagated through a substrate 42 preferably formed of glass after generation by a transducer 44. In a preferred form, the transducer 44 is formed of piezoelectric material and suitably positioned electrodes connected to a power source (not shown). It is to be appreciated that a plurality of these emitters are suitably positioned in rows (preferably in 8 rows) on the print head to form an array.

In its simplest embodiment, the print head is a planar structure that faces a flat platen on which the print medium is mounted. This geometry provides for a uniform E field in the print gap, i.e. the gap between the cover plate and the print medium. In a proposed adaptation of AIP to phase change inks, one new development is the use of drums or belts as the intermediate media to register images prior to their eventual transfuse/transfix onto paper. Preferably, the present print head structures are modules consisting of 8 rows of staggered apertures spaced over 4.4 mm and distributed 1.7" in the length-wise direction. The apertures are 340 um on centers. To write a wider swath in the process direction, one proposal is to mount two such modules together with a 6 mm spacer. This results in a double 8-row print head. As a result, the $1^{st}$ row of the first module and the $8^{th}$ row of the second module are now some 14.8 mm apart. Other more complex configurations include printing onto non-planar medium mounted on moving drums or belts.

Figure 3A:
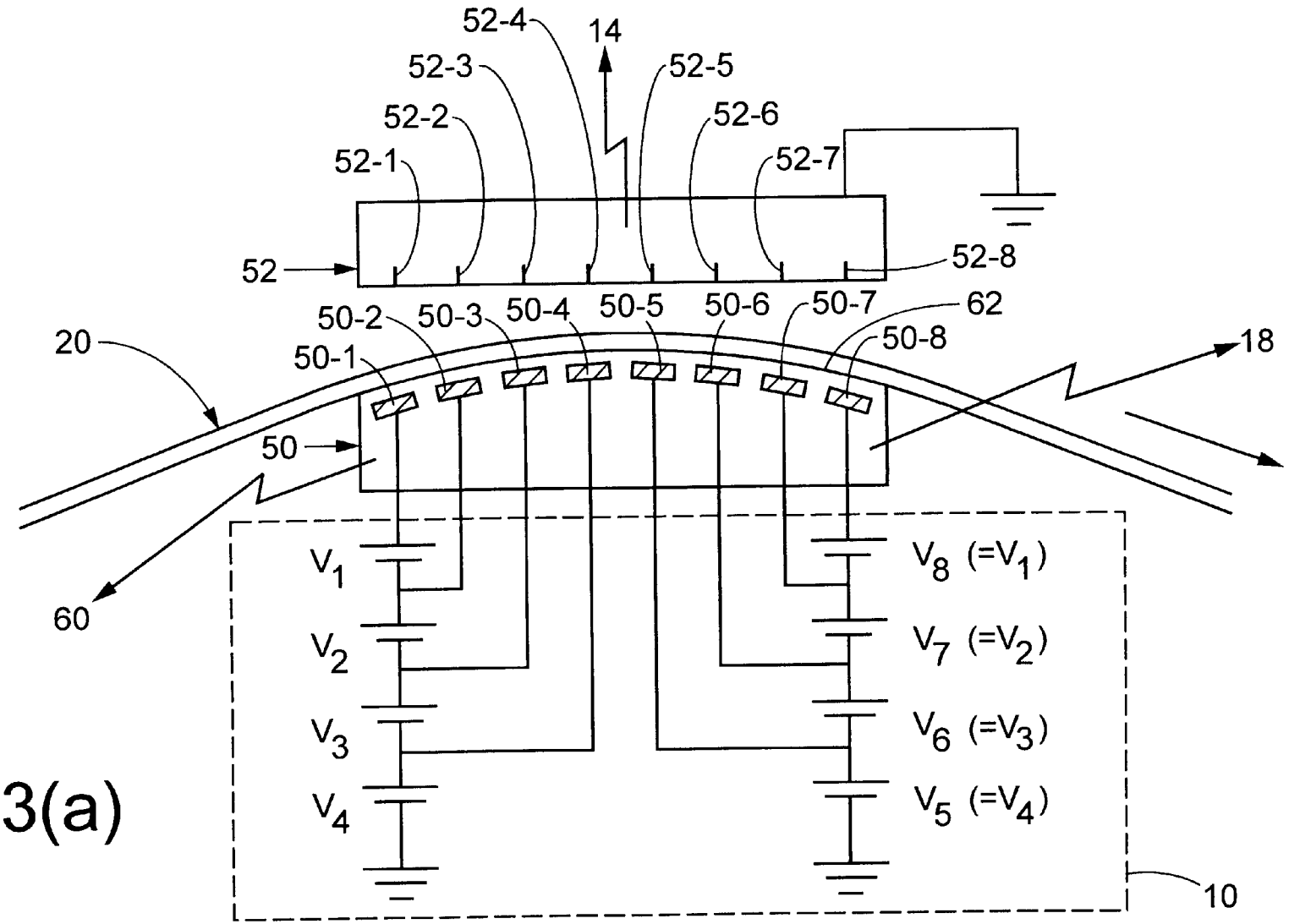
FIGS. 3(*a*)–(*b*) are illustrations of a preferred embodiment according to the present invention.
Figure 3B:
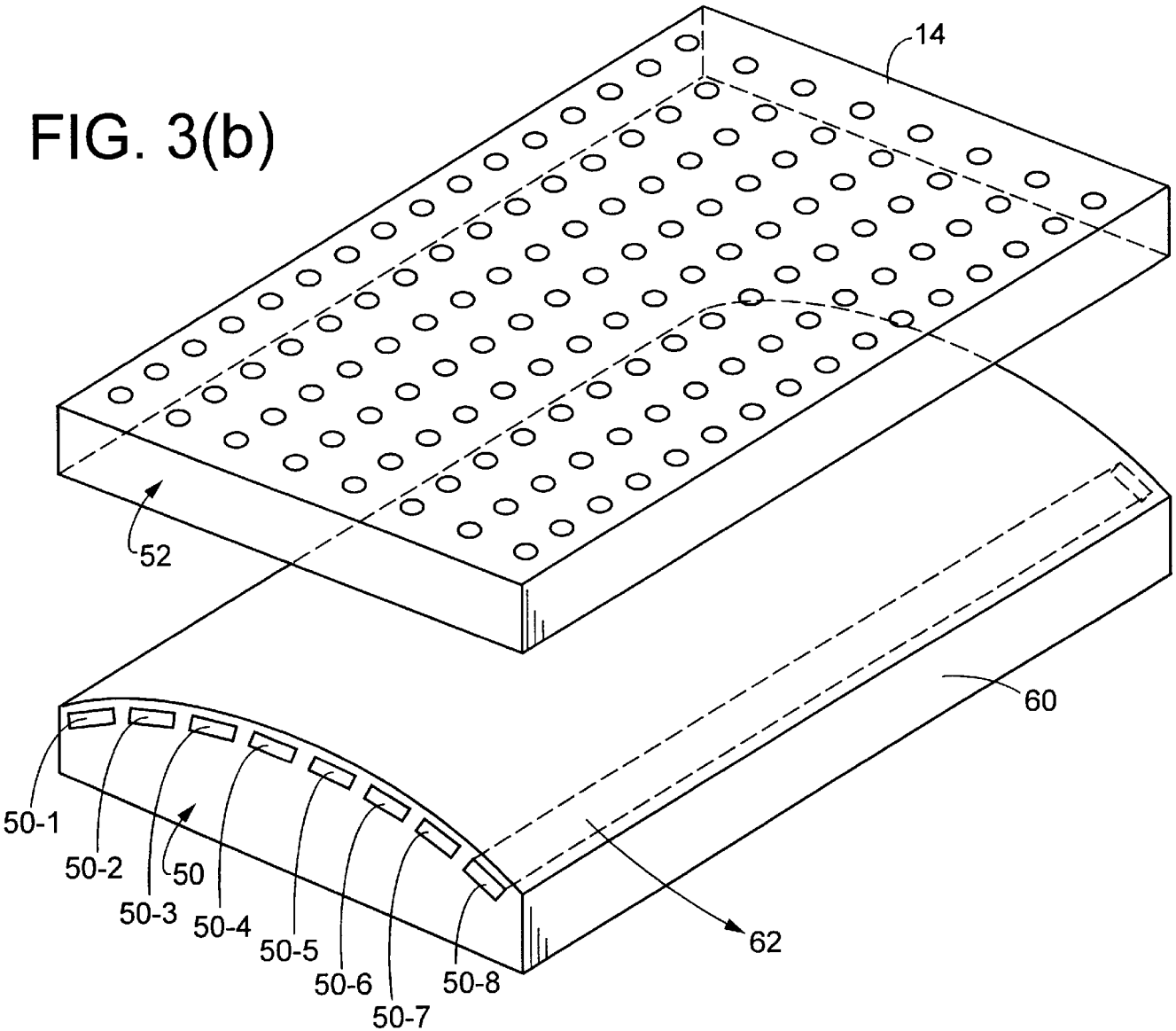

Referring now to FIGS. 3(*a*)–(*b*) and 4(*a*)–(*b*), examples of printing configurations are illustrated wherein non-planar print mediums and/or supports therefor are implemented. In FIG. 3(*a*), the print head 14, which is grounded, is shown positioned to emit drops of fluid, according to signals received from the controller 12, toward the print medium 20 on the support 18. The drop forming device 16 includes the emitters positioned in an array having rows 52 (i.e. 52-1, 51-2, 52-3, 52-4, 52-5, 52-6, 52-7, and 52-8). The print media 20 is, for example, paper from a spool which is then cut after printing, or an intermediate belt from which the image is transferred to paper at another suitable location within the system that will be apparent to those skilled in the art.

As can be seen, segmented electrodes 50 (i.e. 50-1, 50-2, 50-3, 50-4, 50-5, 50-6, 50-7, and 50-8) are embedded in the support structure 18 using techniques that are well known in the art. The support structure 18, in this embodiment, takes the form of a shoe 60 formed of an insulating material. The shoe 60 has a curved surface 62 to facilitate the provision of tension the print media 20. Also shown is a plurality of voltage sources V1–V8 that make up the voltage supply 10 connected to the electrodes 50. It is to be appreciated that the voltages actually applied to the electrodes will vary according to the criteria disclosed herein in accordance with the present invention. Nonetheless, because of the symmetry of the curved surface 62, the electrodes 50-1 and 50-8 are preferably biased with the same voltage. As is apparent from the figure, the electrodes 50-2 and 50-7, 50-3 and 50-6, and 50-4 and 50-5 likewise will be respectively similarly biased.

As shown in FIG. 3(*b*), the electrodes 50 preferably are disposed along the length of the shoe 60 to coincide with the length of the print head. The electrodes 50 also suitably align with the rows 52, as shown. In addition, the curved surface 62 is preferably coated with a suitable layer of nominal 2 mil Teflon to minimize sliding friction.

It should be recognized that if the print head is a full width array (FWA), the print medium will move during printing. In this case, determining, e.g. optimizing, the electrode voltages for reduced, or zero, relative error is desired as will be described in more detail below. However, if the print head is a partial width array (PWA), several passes are required to print an entire page using a scanning mode. The print medium will be stationary, and therefore electrode voltages are determined that result in reduced, or zero, absolute error. The transfer option allows the use of many more types of paper.

Figure 4A:
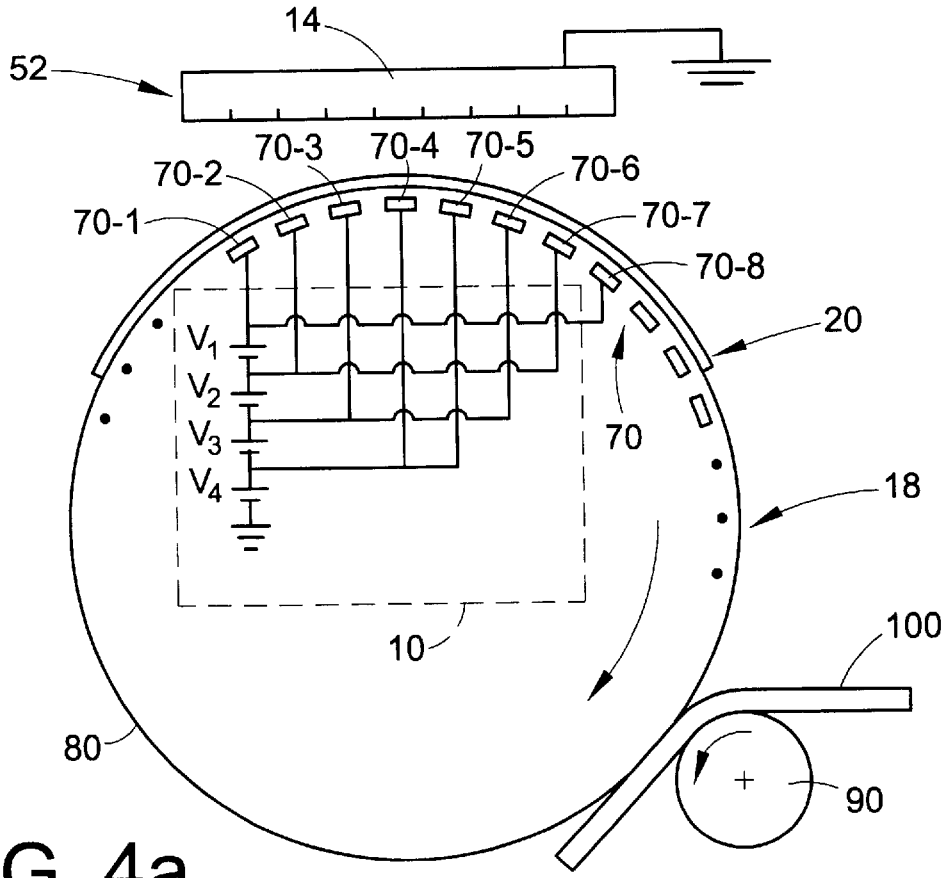
FIGS. 4(*a*)–(*b*) are illustrations of another preferred embodiment according to the present invention.
Figure 4B:
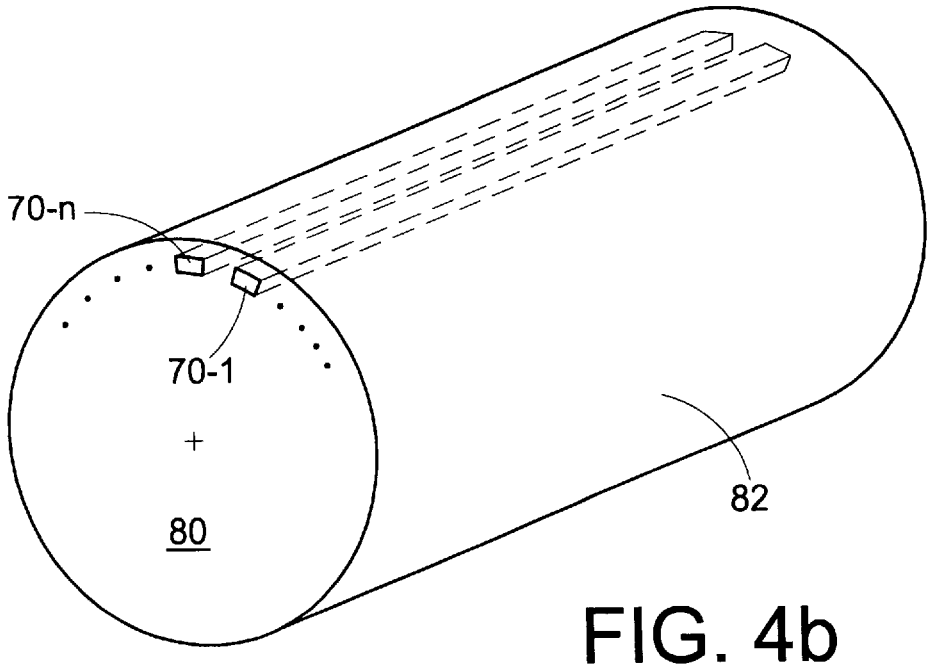

With reference to FIGS. 4(*a*)–(*b*), a drum configuration of the print medium support 18 is shown. Similar to the configuration shown in FIGS. 3 (*a*)–(*b*), the print head 14, which is grounded, is shown positioned to emit drops of fluid, according to signals received from the controller 12, toward the print medium 20 on the support 18. The drop forming device 16 includes the emitters positioned in an array having rows 52 (i.e. 52-1, 51-2, 52-3, 52-4, 52-5, 52-6, 52-7, and 52-8). In this configuration, segmented counter electrodes 70 (i.e. 70-1, 70-2, 70-3, 70-4, 70-5, 70-6, 70-7, 70-8, . . . 70-n) are preferably embedded in a drum 80 under a 2 mil Teflon overcoat. For convenience, only selected electrodes are shown in FIGS. 4(*a*) and (*b*); however, it should be appreciated that electrodes are positioned around the circumference of the drum.

Preferably, only the eight electrodes 70-1 through 70-8 facing, and aligned with, the eight rows 52 of the print head 14 for printing purposes are energized at any given time using commutation switching, as those skilled in the art will appreciate. Further, although any number of electrodes 70 can be provided as convenience will allow, the arrangement of eight energized electrodes is preferably repeated four times around the periphery of the drum 80 for applications such as color printing.

The drum 80 has a curved surface 82 upon which the print media is positioned. Also shown is a plurality of voltage sources V1–V4 that make up the voltage supply 10 connected to the electrodes 70. It is to be appreciated that the voltages actually applied to the electrodes will vary according to the criteria disclosed herein in accordance with the present invention. Nonetheless, because of the symmetry of the curved surface 82, as shown, the electrodes 70-1 and 70-8 are preferably biased with the same voltage. As is apparent from the figure, the electrodes 70-2 and 70-7, 70-3 and 70-6, and 70-4 and 70-5 likewise will be respectively similarly biased. Additional sets of voltage sources could be provided to the additional electrodes or, preferably, a suitable switching arrangement is provided.

The print medium 20 may be paper or an intermediate substrate. The paper is preferably held by gripper bars (not shown). An intermediate substrate, if used, preferably takes the form of an insulating coating on the drum 80.

Where the print medium 20 is actually an intermediate substrate, an additional transfer roll 90 is provided to move the printed image onto paper 100 using a combination of heat and pressure. An additional variation may be the use of a rotating sleeve in place of the drum to move the print medium. This can be implemented using a shoe configuration beneath the sleeve, as those skilled in the art will appreciate.

Figure 5:
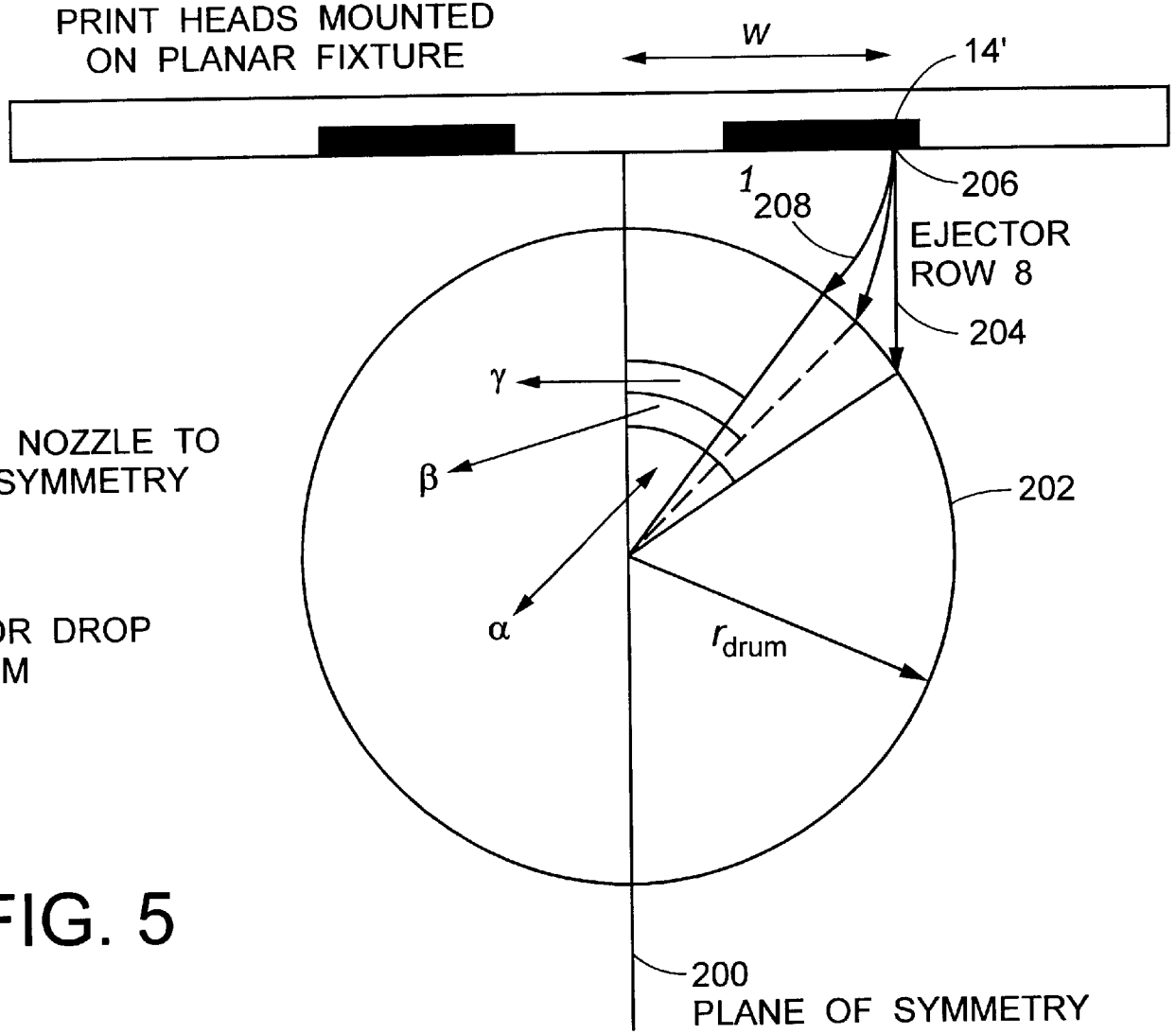
FIG. 5 is a schematic representation of a head and drum.

The configurations illustrated in FIGS. 3(*a*)–(*b*) and 4(*a*)–(*b*) introduce a variety of drop placement errors that have not heretofore been effectively addressed by the art. In this regard, drop placement error is defined as the difference between the impact spot and the target spot. $\delta_\alpha$, $\delta_\gamma$, and $\delta_\beta$, are absolute errors while $\delta_\psi$ is the relative error with respect to a reference ejector row. As follows, these four primary sources of drop placement error are detailed:

1. $\delta_\alpha$: Geometric error due to drum or belt curvature, given by:

$$\delta_\alpha = r_{drum} \sin^{-1}(w/r_{drum}) - w$$

where w is the distance of the ejector nozzle (as shown, located in row 8 of the exemplary head 14') from the plane of symmetry 200, and $r_{drum}$ is the radius of curvature of the non-planar substrate and or/support (e.g. drum 202), with reference to FIG. 5. The first term is a measure of the arc length computed from the plane of symmetry. Therefore, the error is zero when the drop ejected from a nozzle located a distance w from the plane of symmetry 200 lands on the drum 202 at an arc length equal to w. Here, the trajectory is a straight line 204 projected vertically downwards from a nozzle 206 as shown in the FIG. 5. The error forms the positive upper bound of the error envelope, which will be described below.

2. $\delta_\gamma$: Error due to purely electrostatic drift assuming the drop has no mass. Here, the drop moves as a point charge along an E-field line 208 in FIG. 5. This computation provides the negative lower bound of error in drop placement for the error envelope. The corresponding error relation, where $x_\gamma$ is the intercept on the drum, is:

$$\delta_\gamma = r_{drum} \sin^{-1}(x_\gamma/r_{drum}) - w$$

3. $\delta_\beta$: Error computed from force integration, is dependent on the characteristics of the drop, and includes airflow, electrostatics, and drag. Newton's equation of motion is integrated to predict drop trajectories:

$$m\, d^2x/dt^2 = Q_{drop}E - 6\pi\eta r_{drop}V$$

where m is the mass of the drop, $\eta$ is the dynamic viscosity, and V is the velocity. This error lies within the error envelope. With $x_\beta$ as the intercept of the drop on the drum, the error relation is given by:

$$\delta_\beta = r_{drum} \sin^{-1}(x_\beta/r_{drum}) - w$$

4. $\delta_\psi$: Relative error in drop placement with respect to a reference ejector row. For example, with the double 8-row print head shown in FIG. 5, the $2^{nd}$ to $8^{th}$ ejector rows is referenced to the $1^{st}$ by:

$$\delta_\psi = v\Delta T_{flight} = v[T_{flight}(\text{Ejector Row}>1) - T_{flight}(\text{Ejector Row 1})]$$

where v is the velocity of motion of the drum/belt substrate, the $T_{flight}$ is the time of flight of the drops. Differences in $T_{flight}$ between adjacent ejectors are magnified by the velocity of motion, v. Therefore, to achieve zero relative drop placement error, we need to ensure that drops ejected by all the ejector rows have identical $T_{flight}$.

Drop placement errors ($\delta_\alpha$, $\delta_\gamma$, and $\delta_\beta$) are computed for the two print head configurations. These cases correspond to a single 8-row print head and dual 8-row print heads separated by a 6 mm spacer. The absolute errors in drop placement due to both initial ejection velocity U and fringing E fields are computed for the worst case scenario presented by the $8^{th}$ ejector row which is spaced furthest from the vertical plane of symmetry. As shown in FIG. 5, these ejectors correspond to the cases when w=2.2 mm for the single print head, and w=7.4 mm for the double print head, respectively.

All dimensions and operating conditions emulate the experimental setup. These include the quantities listed in the table below. Runs are generated by varying drum radius to determine drop placement error. These are shown in Tables 1 and 2 below, and graphed in FIGS. 6 and 7.

| gap <mm> | H <um> | $r_{drop}$ [um] | U <m/s> | V <kV> | W <mm> |
|---|---|---|---|---|---|
| 0.5 | 140 | 8 | 2.2 | 1.0 | 2.2 & 7.4 |

TABLE 1

Drop placement errors for various drum radii.
Test conditions: w = 2.2 mm, gap = 0.5 mm, V = 1.0 kV, $r_{drop}$ = 8 um, h = 140 um

| | U = 0 <m/s> | | | U = 2.2 <m/s> | | | | |
|---|---|---|---|---|---|---|---|---|
| $r_{drum}$ <cm> | $T_{flight}$ <us> | $V_{impact}$ <m/s> | $\delta_\beta$ <um> | $T_{flight}$ <us> | $V_{impact}$ <m/s> | $\delta_\beta$ <um> | $\delta_\alpha$ <um> | $\delta_\gamma$ <um> |
| 4 | 68.000 | 11.985 | −7.499 | 57.000 | 12.154 | −5.553 | 1.111 | −13.204 |
| 5 | 65.500 | 12.082 | −6.057 | 55.000 | 12.256 | −4.535 | 0.710 | −10.480 |
| 6 | 63.981 | 12.171 | −5.108 | 54.149 | 12.411 | −3.927 | 0.493 | −8.686 |
| 7 | 62.500 | 12.160 | −4.338 | 52.802 | 12.386 | −3.324 | 0.362 | −7.403 |
| 8 | 61.879 | 12.243 | −3.852 | 52.000 | 12.404 | −2.914 | 0.277 | −6.465 |
| 9 | 61.000 | 12.231 | −3.401 | 51.500 | 12.442 | −2.610 | 0.219 | −5.715 |
| 10 | 60.500 | 12.261 | −3.072 | 51.000 | 12.452 | −2.350 | 0.178 | −5.147 |
| 11 | 60.000 | 12.267 | −2.790 | 51.116 | 12.563 | −2.199 | 0.147 | −4.671 |
| 12 | 59.837 | 12.322 | −2.585 | 50.500 | 12.517 | −1.987 | 0.123 | −4.277 |
| 13 | 59.500 | 12.329 | −2.386 | 50.000 | 12.480 | −1.814 | 0.105 | −3.935 |
| 14 | 59.614 | 12.416 | −2.255 | 50.000 | 12.534 | −1.707 | 0.091 | −3.658 |
| 15 | 59.000 | 12.348 | −2.071 | 49.944 | 12.570 | −1.607 | 0.079 | −3.411 |
| 16 | 58.833 | 12.364 | −1.945 | 49.500 | 12.523 | −1.487 | 0.069 | −3.194 |
| 17 | 58.500 | 12.340 | −1.820 | 49.500 | 12.559 | −1.412 | 0.061 | −3.004 |
| 18 | 58.500 | 12.378 | −1.731 | 49.461 | 12.584 | −1.341 | 0.055 | −2.830 |
| 19 | 58.421 | 12.396 | −1.646 | 49.599 | 12.641 | −1.289 | 0.049 | −2.678 |
| 20 | 58.529 | 12.449 | −1.582 | 49.000 | 12.545 | −1.194 | 0.044 | −2.550 |

$\delta_\alpha$: Geometric
$\delta_\beta$: m > 0, E ≠ 0
$\delta_\gamma$: m = 0, E drift

TABLE 2

Drop placement errors for various drum radii.
Test conditions: w = 7.4 mm, gap = 0.5 mm, V = 1.0 kV, $r_{drop}$ = 8 um, h = 140 um

| | U = 0 <m/s> | | | U = 2.2 <m/s> | | | | |
|---|---|---|---|---|---|---|---|---|
| $r_{drum}$ <cm> | $T_{flight}$ <us> | $V_{impact}$ <m/s> | $\delta_\beta$ <um> | $T_{flight}$ <us> | $V_{impact}$ <m/s> | $\delta_\beta$ <um> | $\delta_\alpha$ <um> | $\delta_\gamma$ <um> |
| 4 | 236.144 | 8.324 | −11.522 | 188.844 | 8.548 | 0.379 | 42.874 | −64.785 |
| 5 | 192.500 | 8.933 | −11.473 | 155.647 | 9.166 | −3.127 | 27.285 | −48.514 |
| 6 | 166.056 | 9.413 | −11.188 | 134.500 | 9.606 | −4.363 | 18.890 | −38.590 |
| 7 | 147.500 | 9.751 | −10.294 | 120.450 | 9.965 | −4.983 | 13.853 | −31.842 |
| 8 | 134.487 | 10.041 | −9.618 | 110.000 | 10.234 | −5.074 | 10.594 | −27.083 |
| 9 | 124.500 | 10.264 | −8.903 | 102.348 | 10.470 | −5.092 | 8.363 | −23.557 |
| 10 | 116.976 | 10.470 | −8.359 | 96.626 | 10.690 | −5.084 | 6.770 | −20.802 |
| 11 | 110.500 | 10.606 | −7.704 | 91.431 | 10.825 | −4.813 | 5.593 | −18.591 |
| 12 | 105.500 | 10.747 | −7.232 | 87.407 | 10.960 | −4.623 | 4.698 | −16.832 |
| 13 | 101.467 | 10.883 | −6.844 | 84.000 | 11.073 | −4.423 | 4.002 | −15.342 |
| 14 | 97.817 | 10.978 | −6.428 | 81.000 | 11.159 | −4.203 | 3.450 | −14.078 |
| 15 | 95.194 | 11.116 | −6.186 | 79.078 | 11.305 | −4.150 | 3.005 | −13.053 |
| 16 | 92.000 | 11.136 | −5.727 | 76.500 | 11.334 | −3.871 | 2.640 | −12.125 |
| 17 | 89.858 | 11.227 | −5.475 | 75.194 | 11.469 | −3.831 | 2.339 | −11.330 |
| 18 | 88.041 | 11.318 | −5.267 | 73.000 | 11.467 | −3.566 | 2.086 | −10.638 |
| 19 | 86.000 | 11.348 | −4.970 | 71.500 | 11.519 | −3.417 | 1.872 | −10.021 |
| 20 | 84.500 | 11.415 | −4.774 | 70.500 | 11.609 | −3.345 | 1.690 | −9.464 |

$\delta_\alpha$: Geometric
$\delta_\beta$: m > 0, E ≠ 0
$\delta_\gamma$: m = 0, E drift These experiments are conducted to study the interdependencies of drum radius ($r_{drum}$), drop radius ($r_{drop}$), and initial velocities (U) for fixed gap (g), print head half-width (w), and voltage for E-field assist (V). All references to E field imply V/gap. Errors in drop placement for 8 um drops are computed for various drum sizes. In addition, both geometric and drift errors, $\delta_\alpha$ and $\delta_\gamma$, are also computed. Here, time of flight ($T_{flight}$), impact velocity ($V_{impact}$), and drop placement error ($\delta_\beta$) are computed for initial ejection velocities of 0 and 2.2 m/s. Results for zero initial ejection velocity (drop at rest after ejection) correspond to the reduced drop ejection energy case.

Figure 6:
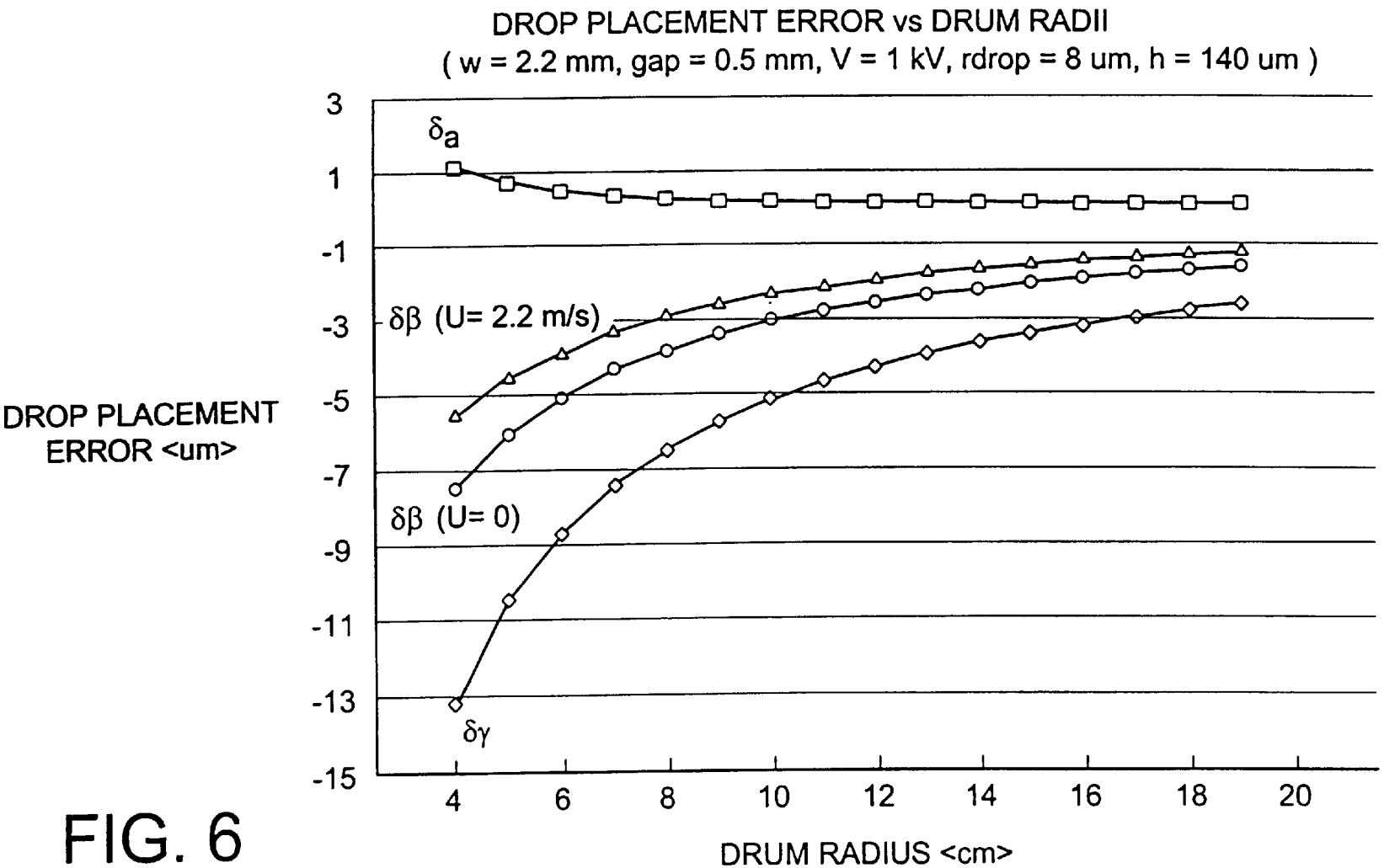
FIG. 6 is a graph showing drop placement errors for a single print head and a range of drum sizes.
Figure 7:
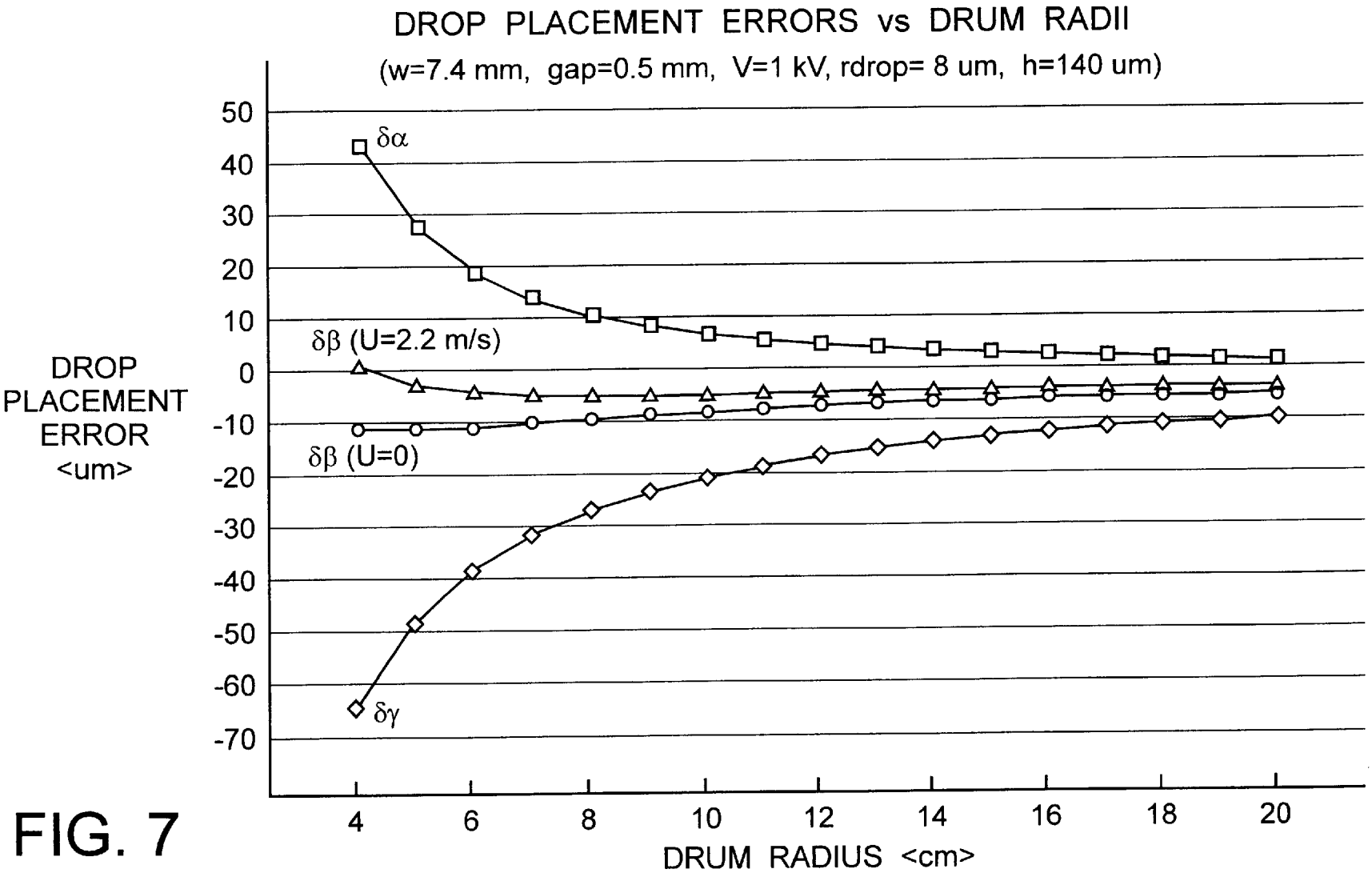
FIG. 7 is a graph showing drop placement errors for double print head and a range of drum sizes.

As can be seen in FIGS. 6 and 7, the error envelope is bounded by: $\delta_\alpha$, representing geometric error due to drum curvature; and $\delta_\gamma$, due to electrostatic drift of a (massless) point charge in the fringing E field. The actual drop placement error, $\delta_\beta$, lies within this envelope. Its proximity to either boundary is an indication of the relative effect of the competing inertial (U>0) and Coulomb forces. The polarity of the error indicates which side of the target spots the drop finally lands. In both FIGS. 6 and 7, $\delta_\beta$ curves are biased negatively, indicating that the E fields (2 V/um) are overdriven with respect to the initial ejection velocity (U=2.2 m/s). The curve corresponding to the U=0 lies further below the U=2.2 curve, indicating that a higher ejection velocity is necessary to compensate for the high E fields. Finally, all curves asymptote to zero error for increasing drum radii.

As illustrated in FIG. 5, the geometric error from printing onto curved surfaces and the inertia of the drop due to the ejection velocity U can be compensated by fringing E fields which pulls toward the center of the drum or belt structure. Therefore, there is a unique set of (U,E) for every drum radius, assuming all other parameters remain unchanged, when absolute drop placement error, $\delta_\beta$, can be forced to be zero. This means that we can use the correct level of E field to steer the drop so that it lands on the target spot.

As such, as is apparent from the descriptions above in connection with FIGS. 1–4(*b*), a system of segmented counter electrodes is implemented on the receiver side of the print gap, i.e. where the print medium support 18 is positioned. The electrodes are then biased to desired voltage, to coincide with the target for the drops on the print medium. One electrode is aligned with each emitter row. These electrodes are preferably positioned so that target spots are located at their centroids.

Figure 8:
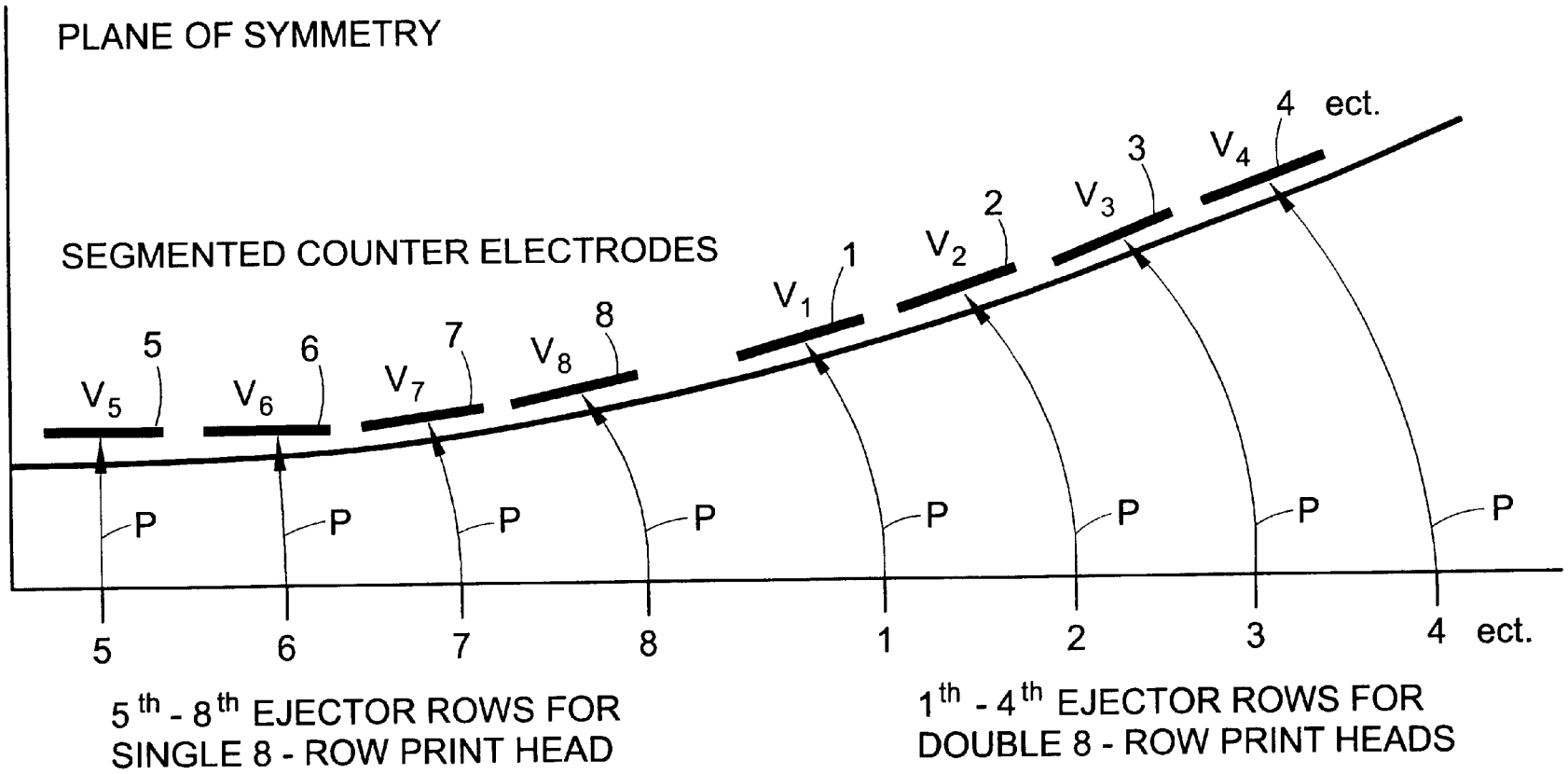
FIG. 8 is a schematic representation of a counter electrode system according to the present invention.

Similarly, for purposes of further explanation, FIG. 8 shows a schematic representation of this concept in a form that varies relative to embodiments described thus far. In this regard, although the representative view of FIG. 8 differs slightly from the configurations shown in, for example, FIGS. 3(*a*)–4(*b*), the features of the invention are equally applicable thereto.

As shown in FIG. 8, for the single 8-row print head, the relevant emitter rows illustrated are 5 to 8. These rows face electrodes 5 to 8. For the double 8-row print head, the relevant ejector rows illustrated are 1–8 (only 1–4 are shown), and they face the corresponding electrode array. Conventional AIP print heads are 4.4 mm for 8 rows of ejectors. This translates into an ejector pitch of 0.6285 mm. Allowing about 0.1 mm for dielectric spacers between adjacent electrodes, we can allocate at least 0.5 mm for electrode width. Across a 0.5 mm gap, there is a 1:1 aspect ratio, so that the electrode will present a well-defined target for the incoming drop.

When any of the configurations of the printing system that meet the objectives of the present invention are implemented, preferably, the desired voltage of each segmented counter electrode is determined and suitable adjustments are made in order to minimize drop placement error for the corresponding ejector row. In this regard, a numerical algorithm based on Newton's method is used to iteratively adjust the electrode voltage in order to minimize the desired quantity. This method is well known to those of skill in the art and may be implemented using a variety of known hardware and/or software techniques.

Preferably, however, the voltage for each segmented electrode is determined sequentially using an iterative algorithm derived from Newton's method where the latest voltage value is related to the previous guess by:

$$V_{k+1}=V_k-f(V_k)/f'(V_k)$$

Here $V_k$ is the voltage at the $k^{th}$ iteration, $f(V_k)$ is the residual representing the drop placement error, and $f'(V_k)$ is the rate of convergence of the residual with respect to the voltage, given by:

$$f'(V_k)=[f(V_k)-f(V_{k-1})]/[V_k-V_{k-1}]$$

The residual is computed by integration of Newton's equation of motion for the drop:

$$m\ d^2x/dt^2=Q_{drop}E-6\pi\eta r_{drop}V$$

which includes consideration for motion of the drop under combined Coulomb and drag forces. The convergence criterion is:

$$V_{k+1}-V_k<\epsilon$$

whereby iteration is terminated when the difference in computed electrode voltage is less than $\epsilon$, a pre-specified tolerance.

For zero absolute error, the relevant equations are:

$$V_{k+1}=V_k-(\delta_\beta)_k/(\delta'_\beta)_k$$

and $$(\delta'_\beta)_k=[(\delta_\beta)_k-(\delta_\beta)_{k-1}]/[V_k-_{k-1}]$$

The corresponding zero relative error equations are:

$$V_{k+1}=V_k-(\Delta T_{flight})_k/(\Delta T_{flight})_k$$

and $$(\Delta T_{flight})_k=[(\Delta T_{flight})_k-(\Delta T_{flight})_{k-1}]/[V_k-V_{k-1}]$$

where $\Delta T_{flight}$ is the relative time of flight between the $n^{th}$ and the $1^{st}$ emitter rows.

Figure 9:
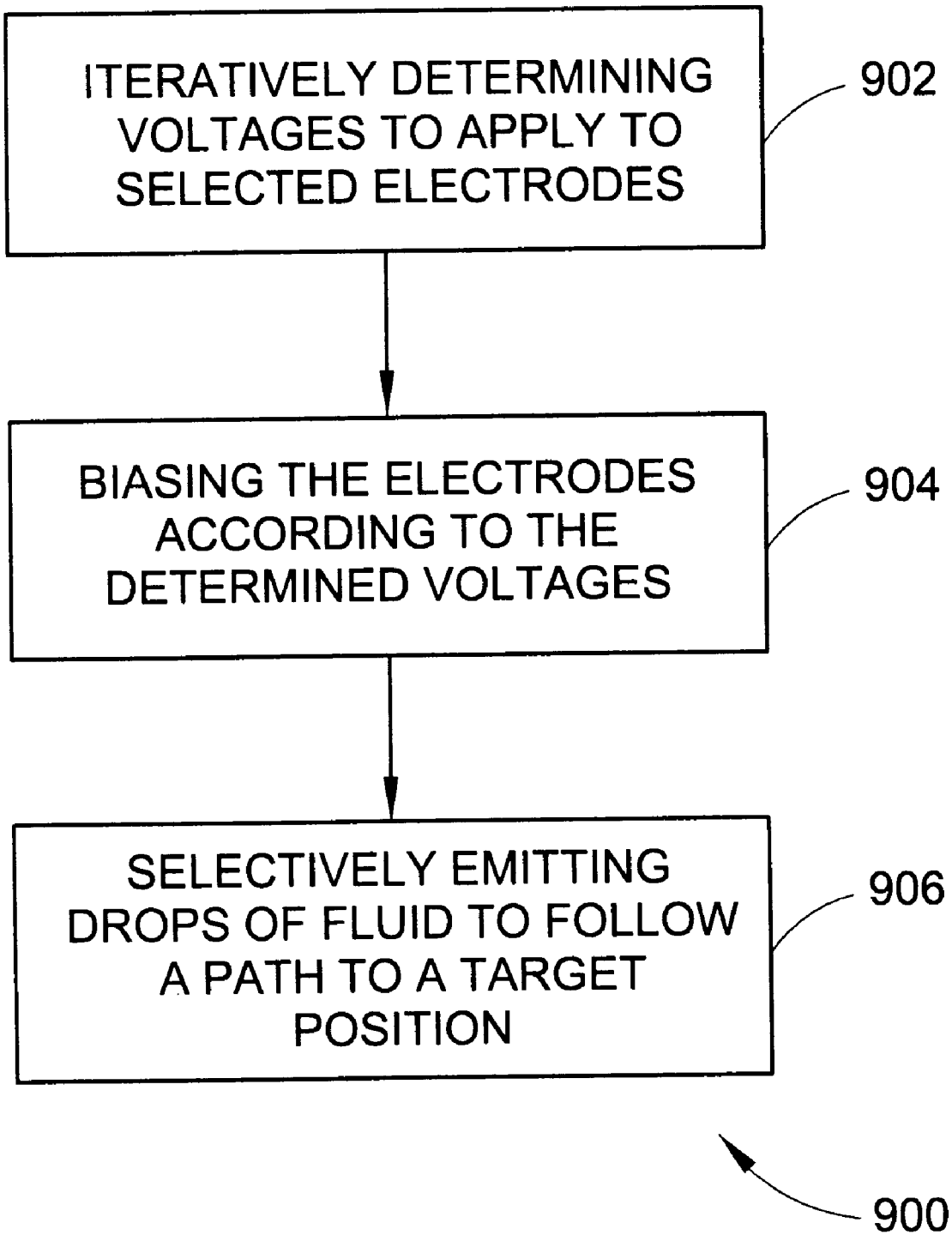
FIG. 9 is a flow chart illustrating a method according to the present invention.

As such, with reference to FIG. 9, a method 900 according to the present invention begins by iteratively determining, by the processor 22 using the above-referenced Newton's method algorithm, voltages to apply to the electrodes (step 902). It is to be appreciated that, preferably, the voltages are determined and set in the system for repeated use. However, there are circumstances where iterative "on-the-fly" determinations are desirable. For example, this would be useful in a system to accommodate different types of paper (e.g. bond, cardboard, linen, etc.) or print medium. The choice of whether to predetermine voltages for the system or calculate voltages for each sheet or run will depend largely on system configuration, processing speed and needs of the user.

Next, the electrodes are biased, by the voltage source 10, based on the determined voltages (step 904). Last, drops are selectively emitted from emitters, based on signals received from the controller 12, such that the drops follow respective paths, such as paths P in FIG. 8, from the emitters to the target positions on the print medium based on the biasing and position of the electrodes relative to the print medium (step 906). With respect to the determination of voltages in step 902, as noted above and reflected in the discussion of the preferred Newton's method, two schemes are proposed to minimize drop placement error. First, absolute error is reduced, preferably to zero ($\delta_\beta$=0), to determine the voltages for stationary media situations. Second, for moving media, relative error is reduced, preferably forced to zero ($\delta_\psi$=0), by enforcing ($\Delta T_{flight}$=0 for all ejector rows referenced to the $1^{st}$ row. As such, the determination of the voltages is based on whether the print medium is in motion during the emitting. If the print medium is in motion during the emitting, the voltages are determined based on maintaining a substantially identical time of flight for the emitted drops. Conversely, if the print medium is stationary during the emitting, the voltages are determined to achieve substantially zero absolute error for drop placement.

Zero Absolute Drop Placement Error ($\delta_\beta$=0)

Figure 10:
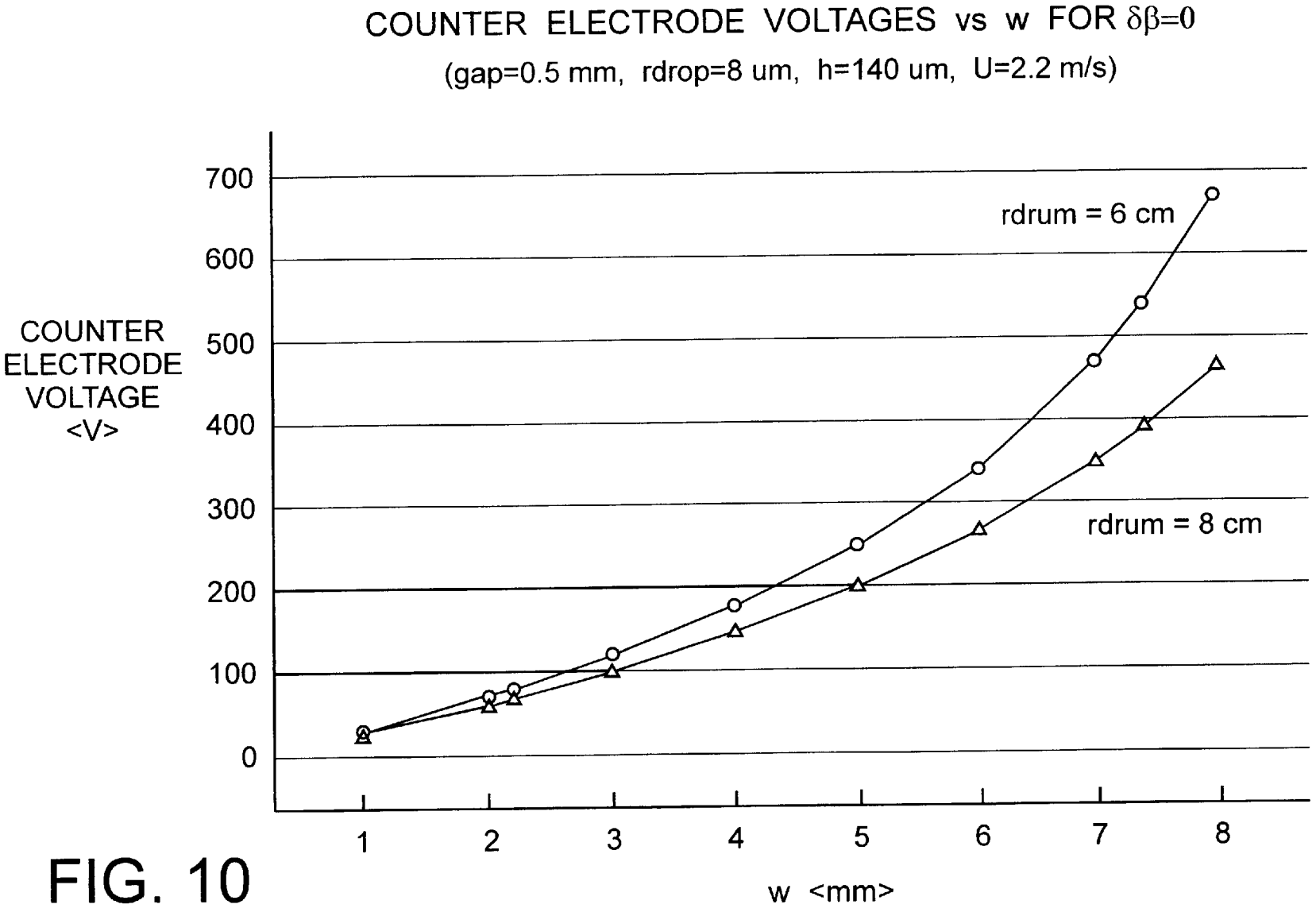
FIG. 10 is a graph showing counter electrode voltages for a range of emitter locations.

As noted above, for circumstances where the print medium is stationary, $\delta_\beta$ can be computed and the bias voltage on electrodes can be iteratively corrected so that $\delta_\beta$ approaches zero within a preset tolerance. Computation is stopped when $\delta_\beta<10^{-4}$ um. Experiments have been conducted for a range of w to represent the locations of the ejector arrays. Results for drum radii of 6 cm and 8 cm are shown in Table 3. Included are computed data for $T_{flight}$, $V_{impact}$, and the bias voltage, V needed to get $\delta_\beta$=0. Results are also graphed in FIG. 10.

For both drum radii, the voltages needed are very reasonable, and increase in some second order fashion to reflect the second order curvature of the gap due to the circular drum geometry. The smaller radius drum requires higher bias voltage for increasing w due to the more rapid widening of the gap. As is evident, this segmented electrode voltage-tailoring scheme is especially beneficial for wide print head structures. It renders absolute drop placement error somewhat independent of drum curvature.

Figure 11:
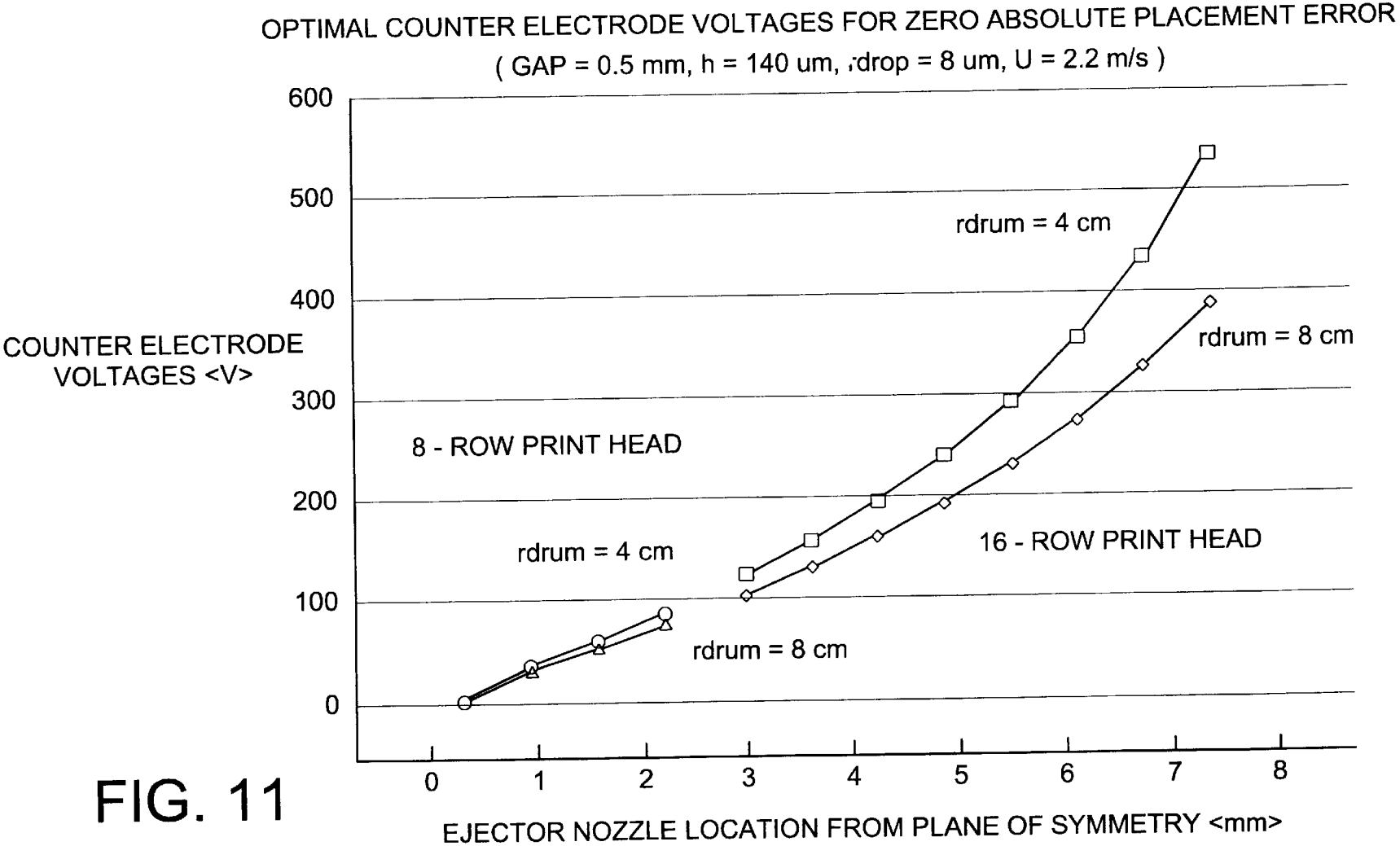
FIG. 11 is a graph showing counter electrode voltages for zero absolute error; and, FIG. 12 is a graph showing counter electrode voltages for zero relative error.

The ejector-electrode pair should be located the same distance measured from the vertical plane of symmetry. The curves in FIG. 10 may be interpreted as the loci of all optimal (V,w) pairs. Table 4 shows the particular (V,w) pairs for the single and double print head configurations considered here. The corresponding curves are shown in FIG. 11.

TABLE 3

Counter electrode voltages versus w for $\delta_\beta$ = 0.
Test conditions: gap = 0.5 mm, h = 140 um, U = 2.2 m/s, $r_{drop}$ = 8 um

| | $r_{drum}$ = 6 cm | | | | $r_{drum}$ = 8 cm | | | |
|---|---|---|---|---|---|---|---|---|
| w <mm> | $Q_{drop}$ <fC> | $T_{flight}$ <us> | $V_{impact}$ <m/s> | V <V> | $Q_{drop}$ <fC> | $T_{flight}$ <us> | $V_{impact}$ <m/s> | V <V> |
| 1.0 | 244.89 | 187.8757 | 1.7424 | 37.92 | 245.96 | 187.3646 | 1.7313 | 33.17 |
| 2.0 | 233.44 | 193.1794 | 1.8873 | 78.11 | 237.19 | 191.4494 | 1.8391 | 66.94 |
| 2.2 | 230.42 | 194.5883 | 1.9279 | 86.71 | 234.85 | 192.5275 | 1.8698 | 74.17 |
| 3.0 | 216.57 | 201.0863 | 2.1300 | 123.85 | 223.89 | 197.6568 | 2.0207 | 104.63 |
| 4.0 | 196.67 | 210.1578 | 2.4788 | 178.75 | 207.60 | 205.2642 | 2.2778 | 147.91 |
| 5.0 | 175.89 | 218.5223 | 2.9582 | 248.07 | 189.83 | 213.0709 | 2.6205 | 199.67 |
| 6.0 | 155.78 | 223.9778 | 3.6081 | 338.90 | 171.86 | 219.8114 | 3.0686 | 263.74 |
| 7.0 | 137.24 | 223.8713 | 4.5308 | 465.16 | 154.57 | 224.4632 | 3.6519 | 345.01 |
| 7.4 | 130.36 | 220.6210 | 5.0337 | 532.92 | 147.97 | 224.9955 | 3.9416 | 384.78 |
| 8.0 | 120.67 | 212.0645 | 6.0114 | 662.63 | 138.49 | 223.5088 | 4.4653 | 455.91 |

$\delta_\beta$: m > 0, E ≠ 0

TABLE 4

Optimal ($\delta_\beta$ = 0) Counter Electrode Voltages for Ejector Rows.

| Ejector Row # | w <mm> | Voltage <V> $r_{drum}$ = 6 cm | Voltage <V> $r_{drum}$ = 8 cm |
|---|---|---|---|
| | Single 8-Row Print Head | | |
| 4 or 5 | 0.3143 | 2.95 | 2.25 |
| 3 or 6 | 0.9429 | 35.95 | 31.22 |
| 2 or 7 | 1.5715 | 60.53 | 52.19 |
| 1 or 8 | 2.2000 | 86.71 | 74.17 |
| | Double 8-Row Print Heads | | |
| 1 | 3.0000 | 123.85 | 104.63 |
| 2 | 3.6285 | 156.99 | 130.99 |
| 3 | 4.2570 | 194.88 | 160.27 |
| 4 | 4.8855 | 238.67 | 193.28 |
| 5 | 5.5140 | 291.25 | 230.46 |
| 6 | 6.1425 | 354.15 | 273.75 |
| 7 | 6.7710 | 432.94 | 324.90 |
| 8 | 7.4000 | 534.33 | 384.78 |

Zero Relative Drop Placement Error ($\delta_\psi$=0)

As defined earlier, the relative drop placement error for a print head is defined as the error in the drop placement of the other seven rows of ejectors referenced to the $1^{st}$ row. For example, in a 16-row print head comprised of two 8-row print head modules spaced 6 mm apart, the maximum relative error ($\delta_\psi$) is between the $1^{st}$ and $8^{th}$ row of ejectors. From Table 3, the relative displacement errors are estimated by applying the equation:

$$\delta_\psi = v\Delta T_{flight} = v[T_{flight}(\text{Ejector Row}>1) - T_{flight}(\text{Ejector Row 1})]$$

The following table indicates that relative displacement errors are sizable even though the absolute error, $\delta_\beta$, for each drop is less than $10^{-4}$ um. Clearly, this magnitude of error implies that imposing zero absolute error would be less than suitable for a moving print medium.

| $r_{drum}$ <cm> | Ejector Row # | w <mm> | $T_{flight}$ <us> | $\Delta T_{flight}$ <us> | V <V> | $\delta_\psi$ @ 10 ips <um> | $\delta_\psi$ @ 40 ips <um> |
|---|---|---|---|---|---|---|---|
| 6 | 1 | 3.0 | 201.0863 | 19.5347 | 123.85 | 4.9618 | 19.8473 |
| | 8 | 7.4 | 220.6210 | | 532.92 | | |
| 8 | 1 | 3.0 | 197.6568 | 27.3387 | 104.63 | 6.9440 | 27.7761 |
| | 8 | 7.4 | 224.9955 | | 384.78 | | |

Therefore, an alternative scheme is considered to iteratively adjust counter electrode voltages while enforcing that smaller compared with the other absolute scheme, and is suited for writing on a moving print medium.

TABLE 5

Field assist voltage versus w for $\Delta T_{flight}$ = 0.
Test Conditions: gap = 0.5 mm, h = 140 um, U = 2.2 m/s, $r_{drop}$ = 8 um

| | $r_{drum}$ = 6 cm | | | | $r_{drum}$ = 8 cm | | | |
|---|---|---|---|---|---|---|---|---|
| w <mm> | $T_{flight}$ <us> | $V_{impact}$ <m/s> | $\delta_\beta$ <um> | V <V> | $T_{flight}$ <us> | $V_{impact}$ <m/s> | $\delta_\beta$ <um> | V <V> |
| Single 8-Row Print Head | | | | | | | | |
| 0.3143 | 186.4746 | 1.6928 | 0.0000 | 2.9984 | 186.3598 | 1.6930 | 0.0000 | 2.4229 |
| 0.9429 | 186.4747 | 1.7627 | −0.0190 | 43.6344 | 186.3598 | 1.7460 | −0.0110 | 37.9106 |
| 1.5715 | 186.4746 | 1.8972 | −0.0960 | 76.3445 | 186.3599 | 1.8470 | −0.0560 | 65.6415 |
| 2.2000 | 186.4747 | 2.0989 | −0.2540 | 111.6069 | 186.3597 | 1.9984 | −0.1490 | 95.0094 |
| Double 8-Row Print Head | | | | | | | | |
| 3.0000 | 201.0863 | 2.1300 | 0.0000 | 123.8512 | 197.6432 | 2.0210 | 0.0000 | 104.6654 |
| 3.6285 | 201.0865 | 2.4585 | −0.2594 | 171.0174 | 197.6432 | 2.2721 | −0.1678 | 143.1679 |
| 4.2570 | 203.1565 | 2.8456 | −0.5610 | 222.4020 | 197.6432 | 2.5695 | −0.3824 | 184.1067 |
| 4.8855 | 201.0863 | 3.2400 | −0.6856 | 275.4113 | 197.6711 | 2.9139 | −0.6244 | 229.0240 |
| 5.5140 | 200.9983 | 3.8043 | −1.1043 | 346.0432 | 197.7138 | 3.3069 | −0.8720 | 279.1364 |
| 6.1425 | 201.0002 | 4.3773 | −1.2307 | 421.1017 | 197.6432 | 3.7414 | −1.0747 | 334.7725 |
| 6.6771 | 201.0763 | 4.9343 | −1.3411 | 494.5775 | 197.7496 | 4.1604 | −1.2457 | 388.3284 |
| 7.4000 | 201.0002 | 5.7104 | −0.9450 | 603.6773 | 197.6435 | 4.7700 | −1.3137 | 468.6695 |

$\delta_\beta$: m > 0, E ≠ 0

$T_{flight}$ be identical for all ejectors in the print head. These electrodes are then biased at the optimal voltages to minimize differences in $T_{flight}$ (or $\Delta T_{flight}$=0) between succeeding ejector rows when compared with the $1^{st}$ row. The computed parameters are set for the reference ejector at a voltage setting where $\delta_\beta$=0 (Tables 3 and 4). With $T_{flight}$ for this ejector as the reference value, $\Delta T_{flight}<\epsilon$, where $\epsilon$ is a specified tolerance ($10^{-1}$ us), is enforced. This condition implies that relative error, $\delta_\psi$=0. However, this constraint is imposed at the expense of allowing some absolute placement error, so that $\delta_\beta \neq 0$.

Figure 12:
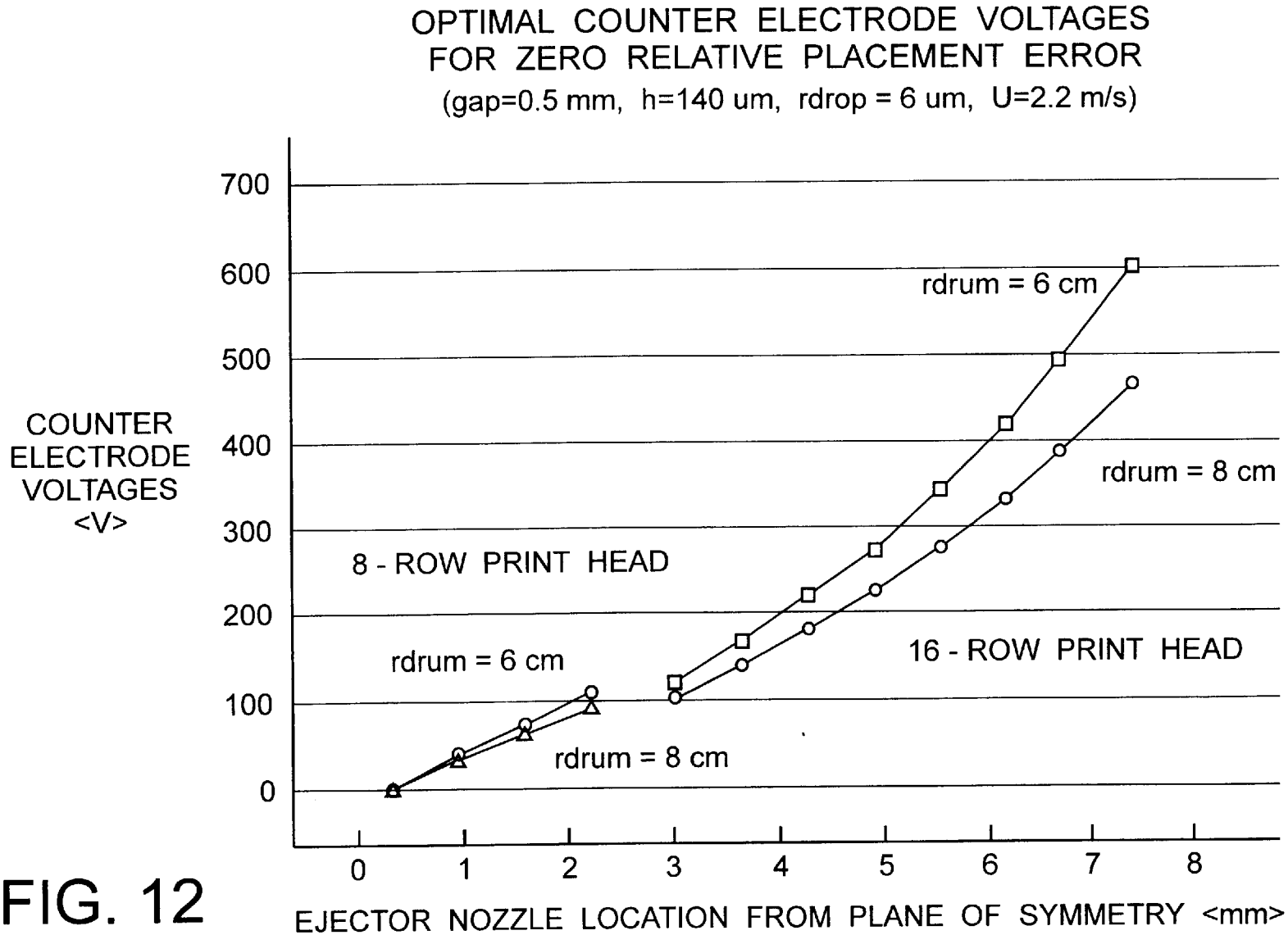

Disregarding airflow in the print gap due to the moving media, the relative error is symmetric about the vertical plane of symmetry. Table 5 shows the optimal segmented electrode voltages for $r_{drum}$=6 and 8 cm, respectively, and with U=2.2 m/s. The optimal electrode voltages for this setting are plotted in FIG. 12. Table 6 and FIG. 12 are for a corresponding case when U=2.7 m/s. The counter electrode voltages are now higher to generate a larger E field to compete with the increased inertia of the drop.

It appears that $\delta_\beta$ is not very sensitive to changes in V over the range of voltages considered. By imposing a more stringent requirement that $\Delta T_{flight}$=0, we accumulate only about 1 um of absolute error, $\delta_\beta$, and yet are able to make the relative error, $\delta_\psi$, vanishingly small. A constant value indicates a DC offset that may be compensated by motion control and registration. In any case, the error is much The above description merely provides a disclosure of particular embodiments of the invention and is not intended for the purposes of limiting the same thereto. As such, the invention is not limited to only the above-described embodiments. Rather, it is recognized that one skilled in the art could conceive alternative embodiments that fall within the scope of the invention.

Having thus described the invention, I hereby claim:

1. A method for reducing drop placement error in printing systems having a printhead positioned to emit drops of ink toward target positions on a print medium positioned on a curved surface, the printhead having rows of emitters and the curved surface having embedded therein segmented electrodes, the electrodes being respectively aligned with the rows, the method comprising steps of:

iteratively determining voltages to apply to the electrodes;

biasing the electrodes based on the determined voltages; and, selectively emitting the drops of ink from emitters such that the drops follow respective paths from the emitters to the target positions on the print medium based on the biasing and position of the electrodes relative to the print medium.

2. The method as set forth in claim 1 wherein the determining of the voltages is based on whether the print medium is in motion during the emitting.

3. The method as set forth in claim 2 wherein, if the print medium is in motion during the emitting, the voltages are determined based on maintaining a substantially identical time of flight for the emitted drops.

4. The method as set forth in claim 2 wherein, if the print medium is stationary during the emitting, the voltages are determined to achieve substantially zero absolute error for drop placement.

5. The method for reducing drop placement error of claim 1 wherein the step of iteratively determining voltages comprises solving equations of motion describing trajectory of drops emitted from the emitters wherein drop target areas on the print medium are specified and wherein E fields from associated electrodes are described.

6. The method for reducing drop placement error of claim 5 wherein the step of solving equations comprises using an iterative method to solve the equations.

7. The method for reducing drop placement error of claim 5 wherein the step of solving equations comprises using Newton's method to solve the equations.

8. An apparatus useful for reducing drop placement error in printing drops of fluid on a print medium, the apparatus comprising:

a head having rows of fluid emitters disposed thereon, the emitters including apertures formed in a cover plate of the printhead, the cover plate being connected to ground;

a controller operative to control emission of drops of fluid from the emitters;

a curved surface having embedded therein electrodes aligned with the rows of emitters, the curved surface being positioned across a gap from the head; and, a processor operative to iteratively determine respective voltages to bias the electrodes, wherein the drops of fluid are selectively emitted from the emitters of the printhead based on signals from the controller, the drops being emitted such that the drops follow respective paths from the grounded cover plate of the emitters to the target positions on the print medium based on the biasing and position of the electrodes relative to the print medium.

9. The apparatus as set forth in claim 8 wherein the head is stationary.

10. The apparatus as set forth in claim 8 further comprising means for moving the head relative to the print medium during printing.

11. The apparatus as set forth in claim 8 wherein the curved surface is disposed on a drum.

12. The apparatus as set forth in claim 8 wherein the curved surface is disposed on a shoe.

13. The apparatus as set forth in claim 8 further comprising means for moving the print medium relative to the head.

14. The apparatus as set forth in claim 8 wherein the processor includes means for determining the voltages based on whether the print medium is in motion during the printing.

15. The apparatus as set forth in claim 14 wherein, if the print medium is in motion during the emitting, the determining means determines the voltages based on criteria to maintain a substantially identical time of flight for the emitted drops.

16. The apparatus as set forth in claim 14 wherein, if the print medium is stationary during the emitting, the determining means determines the voltages to achieve substantially zero absolute error for drop placement.

17. An apparatus for reducing drop placement error in printing systems, the apparatus comprising:

means for emitting drops of ink toward target positions on a print medium, the emitting means having rows of emitters;

means for supporting the print medium, the supporting means having embedded therein segmented electrodes, the electrodes being respectively aligned with the rows;

means for iteratively determining voltages to apply to the electrodes;

means for biasing the electrodes based on the determined voltages; and, means for selectively emitting the drops of ink from the emitting means such that the drops follow respective paths to the target positions on the print medium based on the biasing and position of the electrodes relative to the print medium.

18. The apparatus as set forth in claim 17 wherein the means for determining the voltages bases the determination on whether the print medium is in motion during the emitting.

19. The apparatus as set forth in claim 18 wherein, if the print medium is in motion during the emitting, the voltages are determined based on maintaining a substantially identical time of flight for the emitted drops.

20. The apparatus as set forth in claim 18 wherein, if the print medium is stationary during the emitting, the voltages are determined to achieve substantially zero absolute error for drop placement.

* * * * *